US011724846B2

(12) United States Patent
Bowden et al.

(10) Patent No.: US 11,724,846 B2
(45) Date of Patent: Aug. 15, 2023

(54) OVERHEAD LABEL PRINT AND APPLY SYSTEM

(71) Applicant: ID Technology LLC, Ft. Worth, TX (US)

(72) Inventors: Mark N. Bowden, Nokomis, FL (US); Mark T. Snedecor, Fort Worth, TX (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 0 days.

(21) Appl. No.: 17/389,840

(22) Filed: Jul. 30, 2021

(65) Prior Publication Data

US 2022/0048662 A1 Feb. 17, 2022

Related U.S. Application Data

(60) Provisional application No. 63/069,282, filed on Aug. 24, 2020, provisional application No. 63/064,984, filed on Aug. 13, 2020.

(51) Int. Cl.

| | |
|---|---|
| ***B65C 9/18*** | (2006.01) |
| ***B41J 3/407*** | (2006.01) |
| ***B41J 15/04*** | (2006.01) |
| ***B65C 9/02*** | (2006.01) |
| ***B65C 9/26*** | (2006.01) |

(52) U.S. Cl.

CPC ..... *B65C 9/18* (2013.01); *B41J 3/4075* (2013.01); *B41J 15/044* (2013.01); *B65C 9/02* (2013.01); *B65C 9/26* (2013.01)

(58) Field of Classification Search

CPC ..... B65C 9/18; B65C 9/26; B65C 9/1884

See application file for complete search history.

(56) References Cited

U.S. PATENT DOCUMENTS

| | | | | |
|---|---|---|---|---|
| 6,516,854 | B1 * | 2/2003 | Tsai | B65C 9/1884 156/DIG. 24 |
| 6,619,361 | B1 * | 9/2003 | Swinburne | B65C 9/42 156/542 |
| 2007/0074819 | A1 * | 4/2007 | Constantine | B65C 9/1876 156/542 |
| 2010/0089536 | A1 * | 4/2010 | Austermeier | B65C 9/34 156/556 |

(Continued)

FOREIGN PATENT DOCUMENTS

| | | |
|---|---|---|
| EP | 0689997 B1 | 10/1998 |
| EP | 3070015 A1 | 9/2016 |

(Continued)

OTHER PUBLICATIONS

See Admitted Prior Art in paragraphs [0002 - 0006] of the present application.

*Primary Examiner* — Philip C Tucker
*Assistant Examiner* — John Blades
(74) *Attorney, Agent, or Firm* — Thompson Hine LLP

(57) ABSTRACT

An overhead label print and apply system includes a conveyance path, a common label applier located above the conveyance path, a first label print and dispense unit and a second label print and dispense unit. The first label print and dispense unit is positionable to feed printed labels to the common label applier. The second label print and dispense unit is positionable to feed printed labels to the common label applier.

19 Claims, 12 Drawing Sheets

(56) References Cited

U.S. PATENT DOCUMENTS

| | | | | |
|---|---|---|---|---|
| 2015/0007936 | A1 | 1/2015 | Bernhard | |
| 2016/0264282 | A1 | 9/2016 | Albéniz García-Falces | |
| 2017/0225819 | A1* | 8/2017 | Hirata | B65C 3/06 |
| 2020/0399008 | A1* | 12/2020 | Oh | B65C 9/42 |

FOREIGN PATENT DOCUMENTS

| | | | |
|---|---|---|---|
| ES | 2748905 | A1 | 3/2020 |
| JP | H0199943 | A | 4/1989 |
| WO | WO 2020115126 | A1 | 6/2020 |

* cited by examiner

OVERHEAD LABEL PRINT AND APPLY SYSTEM

TECHNICAL FIELD

The present application relates generally to label printing and applying and, more particularly, to an overhead label print and apply system for printing labels and labeling items as the items are conveyed along a path.

BACKGROUND

Material handling systems are used in many different industries and often include complex packaging and conveyor systems that convey items, such as cases (boxes), quickly from one place to the next within a facility or multiple facilities. Labeling is often necessary to convey information about the cases so that the cases can be identified, categorized, and/or properly routed, among other reasons. One type of known system uses on overhead label printer and applier, with the cases to be labeled moving along a conveyance path below the printer and applier.

Traditional overhead systems for printing and applying labels using applicators mounted overhead, or top down, use a fixed printer applicator with the applicator and printer produced as a single assembly. These are typically called Print And Apply (PANDA) units. Such units require occasional replacement of the label stock rolls that feed labels to the print station of the PANDA unit, which results in down time of the unit. When a customer requires zero down time (ZDT) operation, additional PANDA units are installed, which additional units come online when the other PANDA unit(s) fault for low label etc. This traditional approach has some flaws.

Two complete PANDA units must be purchased and installed for ZDT operation. Additional packaging line space is required to accommodate the two PANDA units, and this space demand is further compounded by space that must be left between each unit for access.

Also, an integrator must manage sending the correct data to the correct applicator at the correct time. Sending data to two applicators in two different apply location increases the chances of a label being applied to the wrong case.

When servicing or loading the traditional PANDA units, the operator is required to work on the labeler while leaning over the conveyor belt with product running. Testing of the printer after loading labels is difficult because of the product traveling under the applicator. One some lines, with some protection protocols, this work requires the line to be shut down completely.

It would be desirable to provide an overhead label print and apply system that, in some cases, enables zero down time while overcoming one or more of the above-noted flaws of existing PANDA unit systems.

SUMMARY

In one aspect, an overhead label print and apply system includes a conveyance path, a common label applier located above the conveyance path, a first label print and dispense unit and a second label print and dispense unit. The first label print and dispense unit is positionable to feed printed labels to the common label applier. The second label print and dispense unit is positionable to feed printed labels to the common label applier.

In another aspect, an overhead label print and apply system includes a conveyance path, a common label applier located above the conveyance path, a first label print and dispense unit and a second label print and dispense unit. The first label print and dispense unit is positionable in a use position to feed printed labels to the common label applier. The second label print and dispense unit is positionable in a use position to feed printed labels to the common label applier.

In a further aspect, method of labeling items moving along a conveyance path involves: (a) using an overhead label print and apply system that includes a common label applier, a first label print and dispense unit and a second label print and dispense unit; (b) the common label applier applying a first label to a first item moving along the conveyance path, wherein the first label is fed to the common label applier by the first label print and dispense unit; and (c) after step (b), the common label applier applying a second label to a second item moving along the conveyance path, wherein the second label is fed to the common label applier by the second label print and dispense unit.

The details of one or more embodiments are set forth in the accompanying drawings and the description below. Other features, objects, and advantages will be apparent from the description and drawings, and from the claims.

DETAILED DESCRIPTION

Referring to FIGS. 1-6, an overhead label print and apply system 10 is shown and includes a label applier 12 and two label print and dispense units 14*a*, 14*b*. Here, the label applied 12 includes a label applying plate/pas 12*a* on a pivotable arm 12*b* that is movable by a linear actuator 12. Each label print and dispense unit 14*a*, 14*b* includes a respective label supply roll 16*a*, 16*b* and label feed system that feeds labels past a label printer 18*a*, 18*b* for printing and then dispenses the printed labels to the label applier 12. Unit 14*a* dispenses labels in a left to right side direction (relative to the view of FIG. 1) toward the label applier, and the other of the units 14*b* dispenses labels in a right to left side direction (relative to the view of FIG. 1) toward the label applier.

Figure 1:
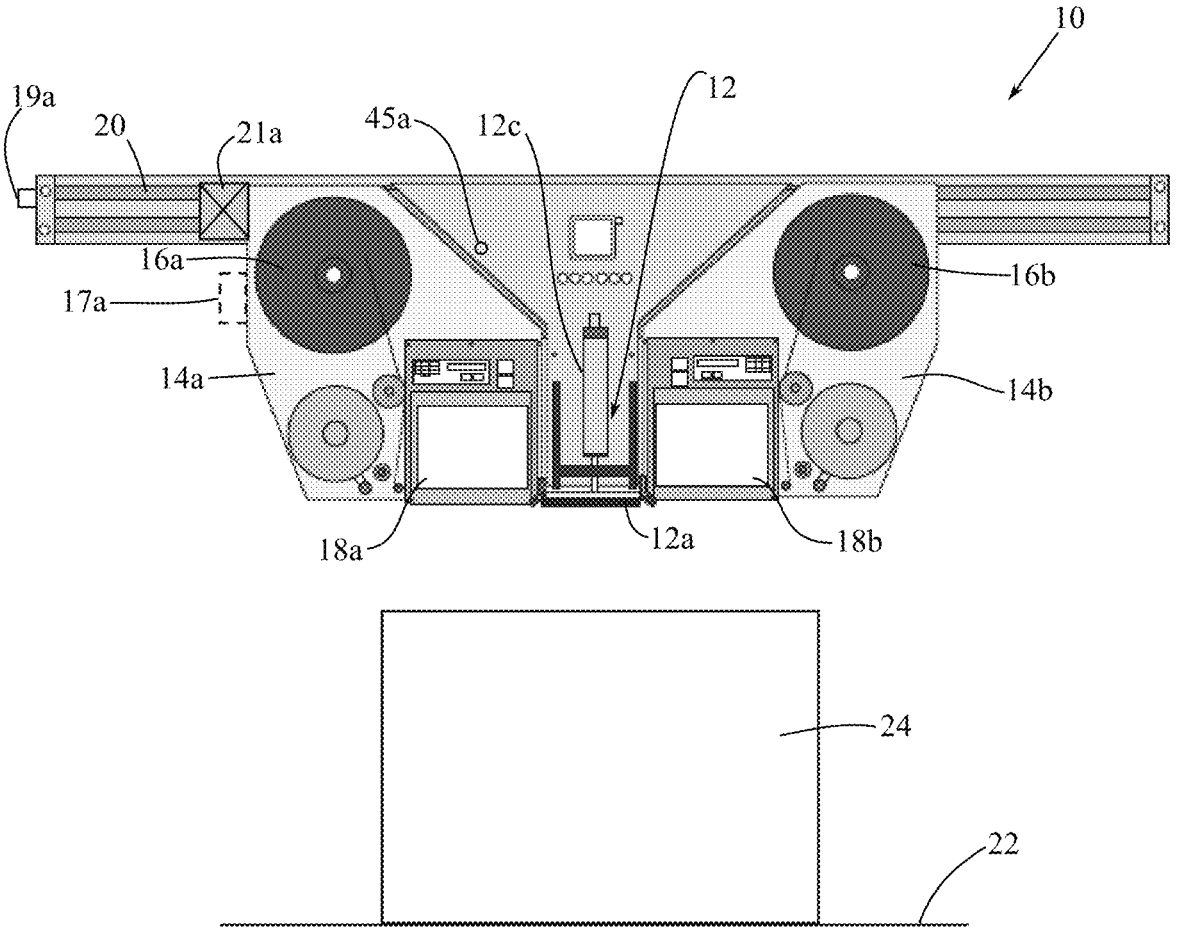
FIG. 1 is a partial schematic view of one embodiment of an overhead label print and apply system (with conveyor travel direction into or out of the page)
Figure 2:
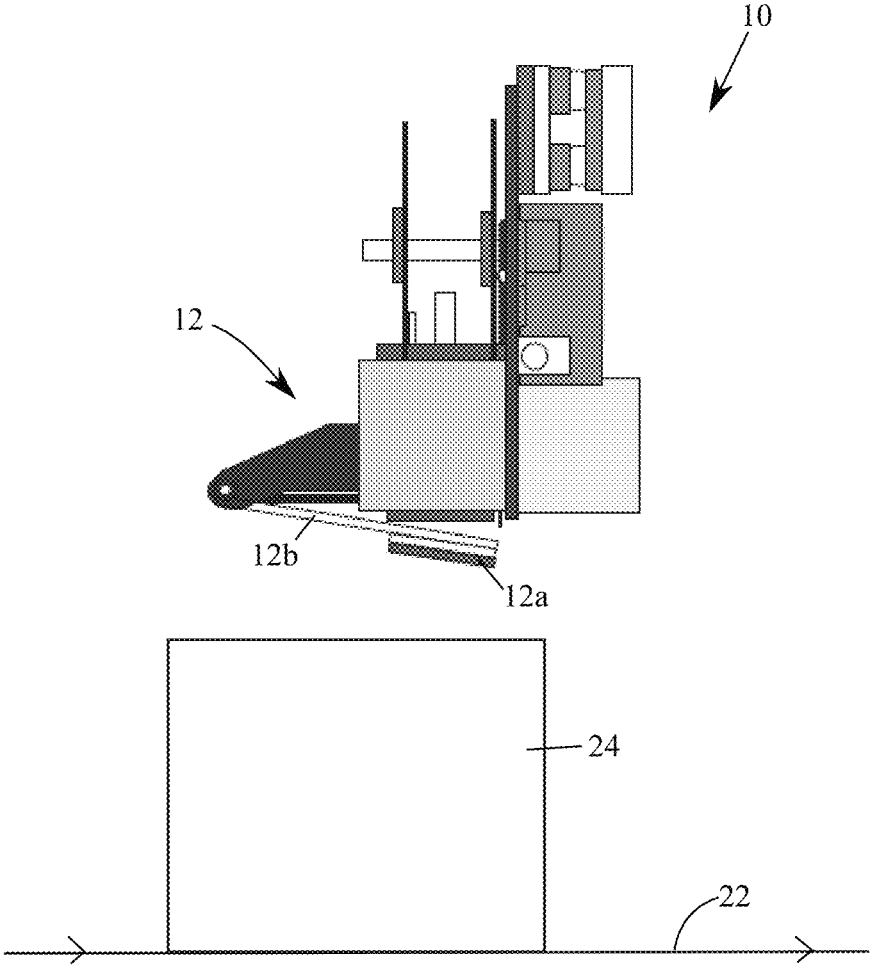
FIG. 2 is a side view of the system of FIG. 1
Figure 3:
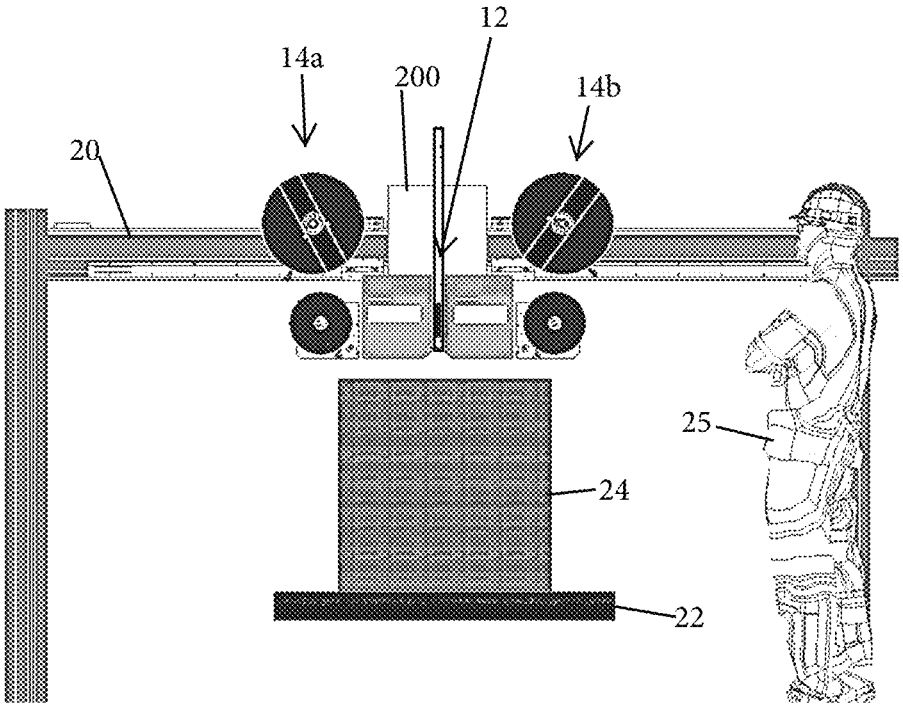
FIGS. 3-6 shows the system with components in various positions.
Figure 4:
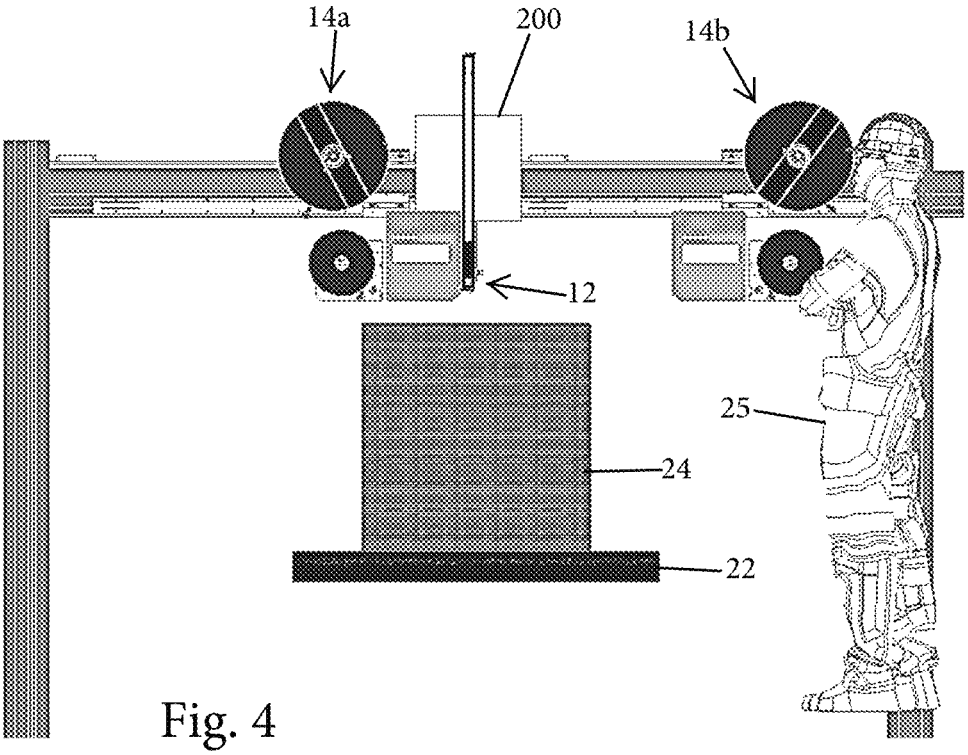
Figure 5:
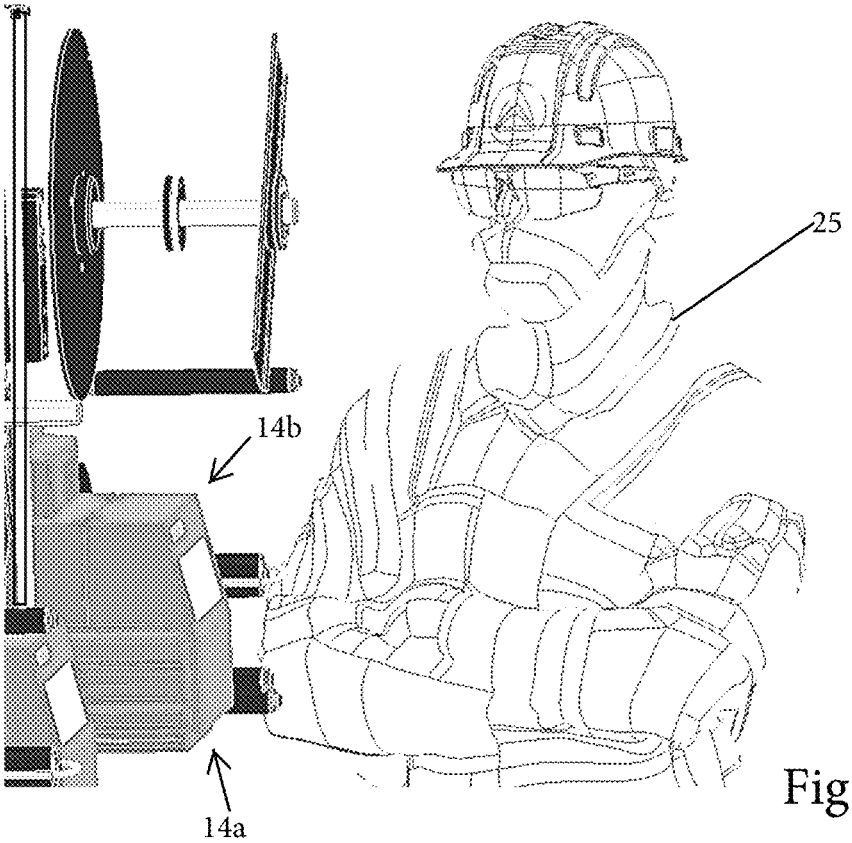
Figure 6:
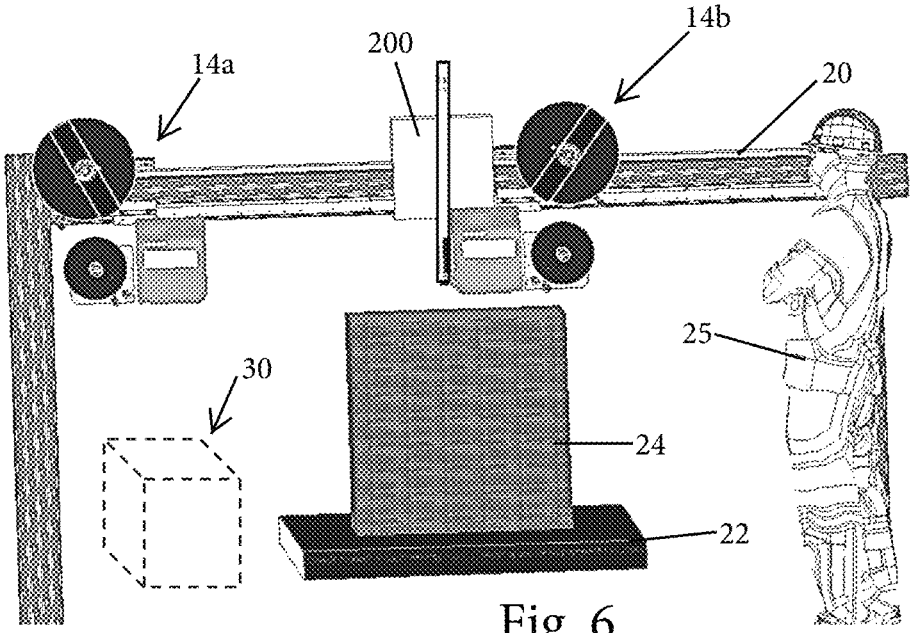

Here, the label applier 12 and each label print and dispense unit 14*a*, 14*b* is mounted on a rail 20 that is supported on frame posts and extends laterally overhead a conveyor 22 that conveys cases 24 (or other items) below the label applier 12. In the view of FIG. 1, the conveyor conveys the cases in a direction into the page, while in FIG. 2 the conveyance direction is left to right. Each label print and dispense unit 14*a*, 14*b* is movable along the rail 20 between the use position, adjacent the label applier 12, shown in FIGS. 1 and 2, and an access position, spaced away from the label applier 12, per unit 14*b* in FIG. 4 or unit 14*a* in FIG.

6. Thus, each label print and dispense unit 14*a*, 14*b* is physically separate or separable from the label applier 12, but both label print and dispense units 14*a*, 14*b* are positioned or positionable (in the use position) to dispense printed labels to the label applier 12. Thus, the same label applier 12 can apply printed labels, from either one of the label print and dispense units 14*a*, 14*b*, to the cases 24 moving below the applier.

The manner in which each print and dispense unit 14*a*, 14*b* is movable along the overhead rail can be achieved in a variety of ways. In one embodiment, the overhead rail 20 is configured as a slide rail, and each label and dispense unit is mounted for sliding movement along the rail. In one implementation, the sliding movement is achieved manually, such as by line personnel grasping the print and dispense unit (e.g., by a housing of the unit or a handle 17*a* of the unit) and pushing or pulling the unit. In another implementation, movement of each print and dispense unit along the rail is achieved by a powered system (e.g., line personnel press a button 19*a* that triggers operation of a drive 21*a* (e.g., servo drive, pneumatic drive or other) that effects the sliding movement). Other variations are possible, including automated movement of the print and dispense units under certain conditions (e.g., a controller 200 (e.g., a controller that is common to the label applier 12 and both units 14*a* and 14*b*) is configured to automatically effect movement of a unit from the use position to the access position when the unit fails or faults). In certain implementations, locking or latching mechanisms are provided to releasably retain the units 14*a*, 14*b* in the use positions. In addition, sensors (e.g., 45*a*) are provided to enable the controller 200 to detect whether each unit 14*a*, 14*b* is in its use position.

Thus, the described system 10 separates the printing and dispensing of the label from the function of the applicator 12. The two print and dispense units 14*a*, 14*b* feed the same label applier 12 from two different (e.g., here opposite) directions.

In embodiments, the controller 200 is configured to send print data, at the same time, to both units 14*a*, 14*b* every time a label is to be printed. Thus, the data to be printed for each product will be sent to both printers. Only one of the printers (i.e., the active printer) will actually print, the other is a backup. The printer that does not print will hold on to the print format in its buffer to print whenever it is triggered to print (e.g., as by signal from the controller). However, the data in the buffer will no longer be valid. Therefore, with each new product to be labeled, the print data is prefaced with a "clear buffer" command to be sure the unused format is removed from the buffer and discarded.

The active print and dispense unit for any given print can be established based upon different operating modes. In one mode, the controller is configured such that a given print and dispense unit is designated as active, starts feeding to the labeler and continues until it has a fault or runs out of labels. At that point, the other print and apply unit is designated as active and takes over until it faults or runs out of labels. When the printer of one print and dispense unit is active, the printer of the other unit can be replenished (e.g., with a new set of labels) so it is ready to take over when needed. In another mode, the controller is configured such that each print and dispense unit is designated as active for every other print (each printer printing every other label and if one faults out the other becomes active for all prints). In still another mode, the controller is configured such that one print and dispense unit (e.g., the first) is designated as active for most of the printing and the other (the second) is only designated as active while the first is being replenished. Once the first print and dispense unit is ready again, the first print and dispense unit is designated as active and takes back over the label printing tasks (basically one print and dispense unit is only there as a backup).

Notably, the single applicator 12 and the two print and dispense units 14*a*, 14*b* are all mounted on the overhead rail 20. Either of the print and dispense units 14*a*, 14*b* can be slid away from the applicator 12 and out to the side of the line where the operator 25 can safely and easily load, clean and test print and feed the unit prior to sliding the unit back in place. In some cases, each print and dispense unit 14*a*, 14*b* may be at an elevated height, because the units 14*a*, 14*b* are not over the conveyor when in the access position, and a platform(s) 30 can be provided to allow operators to more easily access at an ergonomically correct height.

If either of the print and dispense units 14*a* or 14*b* fails completely, the failed unit can be slid off the rail entirely and replaced with another unit, with no down time being incurred (i.e., the line does not need to be shut down to replace a label print and dispense unit).

In some embodiments, the applicator 12 may also be slidably mounted on the overhead rail 20, so that the applicator 12 can also be pulled back from its position over the conveyor 22 should the applicator 12 need servicing. In such embodiments, like the units 14*a*, 14*b*, if the applicator 12 has failed completely, the applicator can be replaced with minimal down time by removing it from the rail.

The controller 200 may take on various forms, incorporating electrical and electronic circuitry and/or other components. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the device or the control functions of any component thereof.

The described system provides numerous benefits, including: (i) a zero down time (ZDT) labeling solution with minimal additional footprint; (ii) a ZDT system at lower cost than two complete PANDA units, (iii) elimination of any timing issues by allowing the label to be printed and applied in the same place, regardless of which printer effects the print, (iv) allowing the operators (line personnel) to load and test the printer without leaning over the product line and exposing themselves to the traveling cases.

Figure 7:
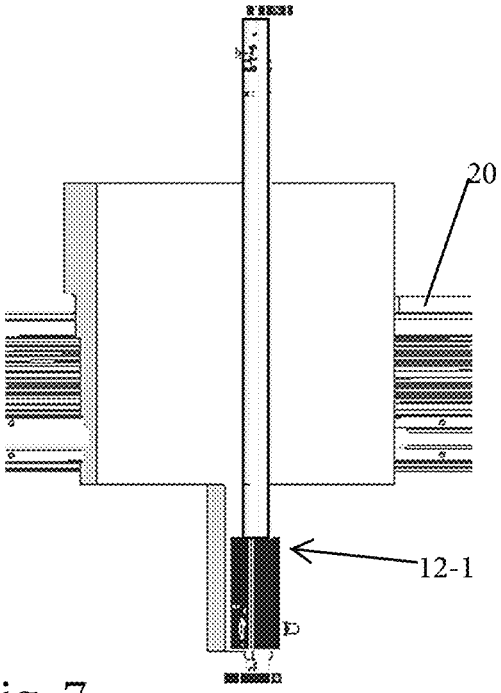
FIGS. 7-10 depict different embodiments of label appliers.
Figure 8:
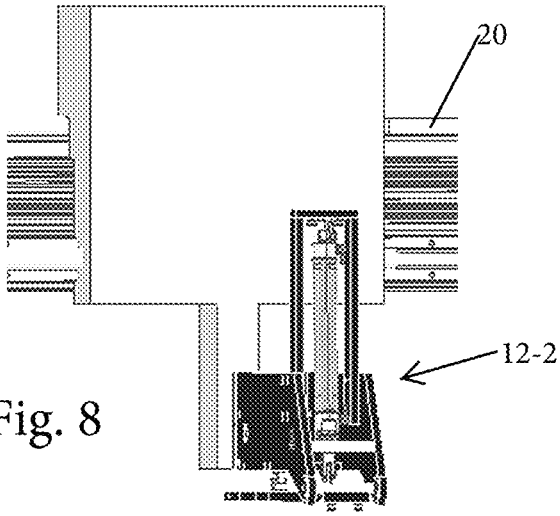
Figure 9:
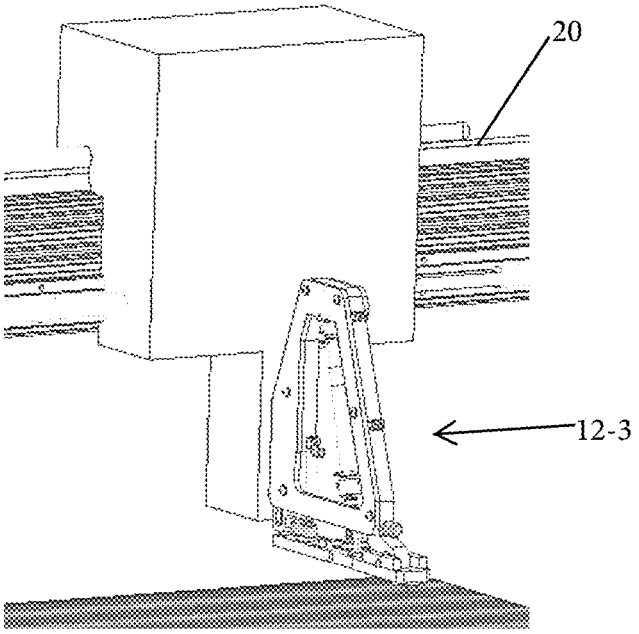
Figure 10:
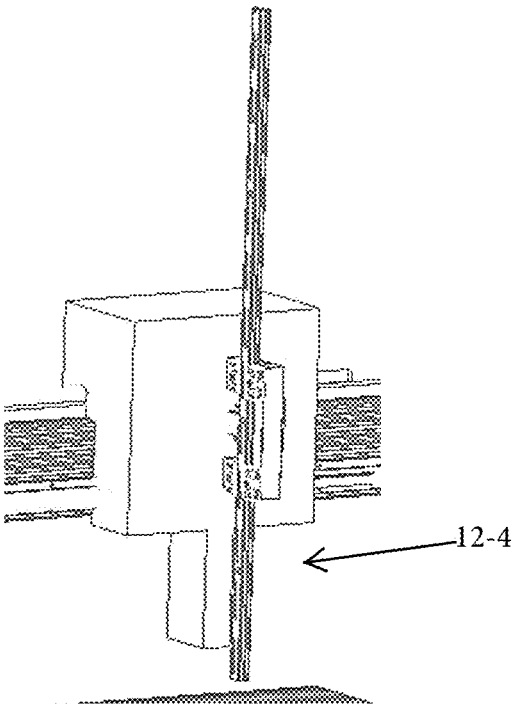

As suggested by FIGS. 7-10, the system can be implemented using a variety of label applicator styles. FIG. 7 shows a pneumatic tamp type applicator 12-1 that moves linearly up and down. FIG. 8 shows a swing arm type applicator 12-2. FIG. 9 shows a low-profile swing arm type applicator 12-3. FIG. 10 shows an electric tamp type applicator 12-4.

Figure 11:
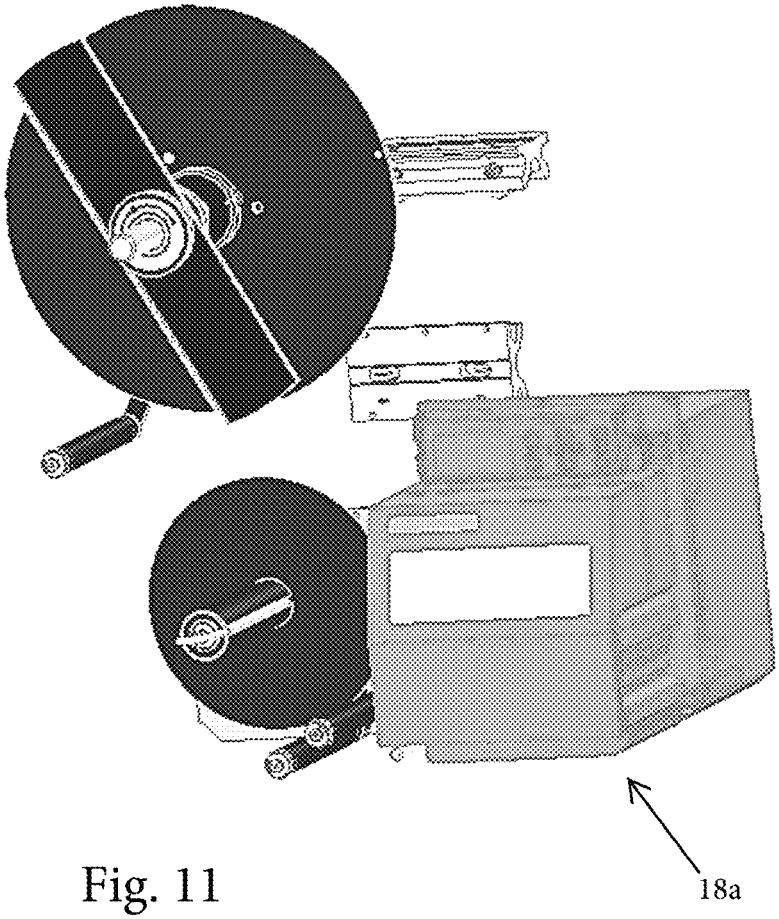
FIG. 11 shows a self-contained print module.
Figure 12:
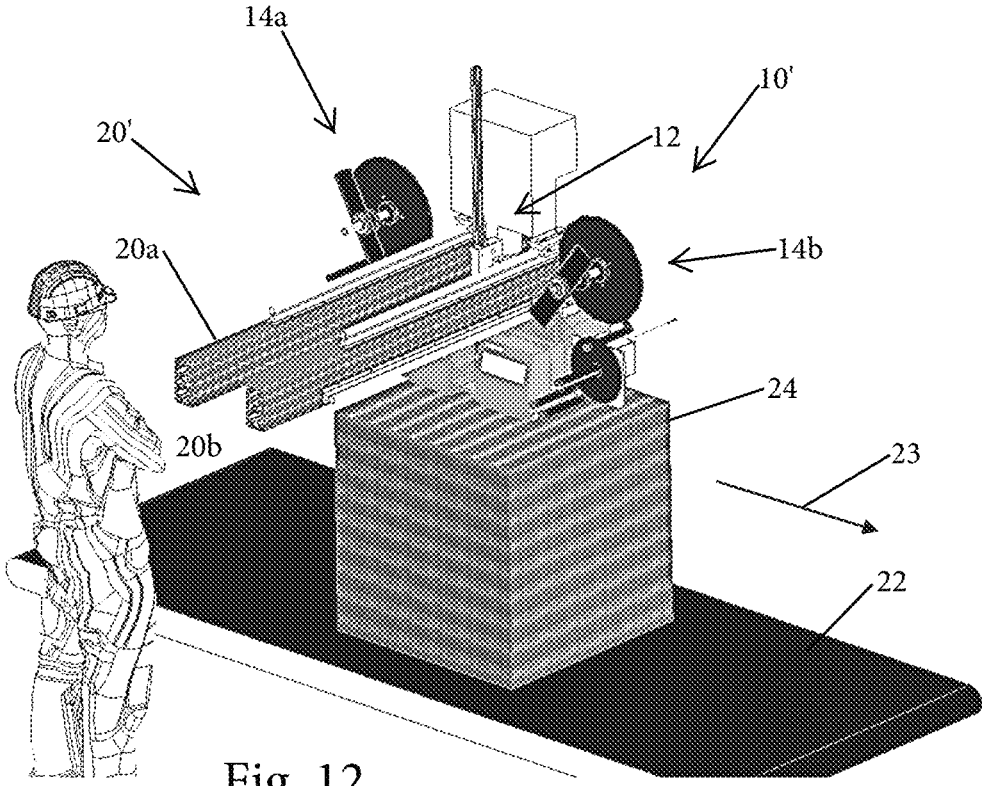
FIGS. 12-17 show another embodiment of an overhead label print and apply system.

In one embodiment, the printer (e.g., 18*a*) of each print and dispense unit may be formed as a self-contained module, as suggested in FIG. 11. In such case, the print module could be easily removed from the rest of the print and dispense unit.

Referring now to FIGS. 12-17, another embodiment of an overhead label print and apply system 10' is shown and includes a label applier 12 and two label print and dispense units 14*a*, 14*b*. Each label print and dispense unit 14*a*, 14*b* includes a respective label supply roll or reel 16*a*, 16*b* and a label feed system that feeds labels past a label printer 18*a*,

18*b* for printing and then dispenses the printed labels to the label applier 12. One of the units 14*a* dispenses labels in a left to first direction toward the label applier, and the other of the units 14*b* dispenses labels in a second direction toward the label applier. Here, the first direction is an upstream to downstream direction, relative to the conveyance direction 23 (substantially the same as the conveyance direction), and the second direction is substantially opposite the first direction (downstream to upstream relative to the conveyance direction (substantially opposite to the conveyance direction).

Here, an overhead rail system 20' is formed by a rail segment 20*a* and a rail segment 20*b*, where the two segments run parallel to each other and alongside each other in a direction substantially perpendicular, or otherwise transverse, to the conveyance direction 23 of cases to be labeled. The rail system 20' enables both label print and dispense units 14*a*, 14*b* to be moved to respective access positions that are both on the same side of the conveyor 22 (rather than on opposite sides of the conveyor as in the case of system 10 described above).

Figure 13:
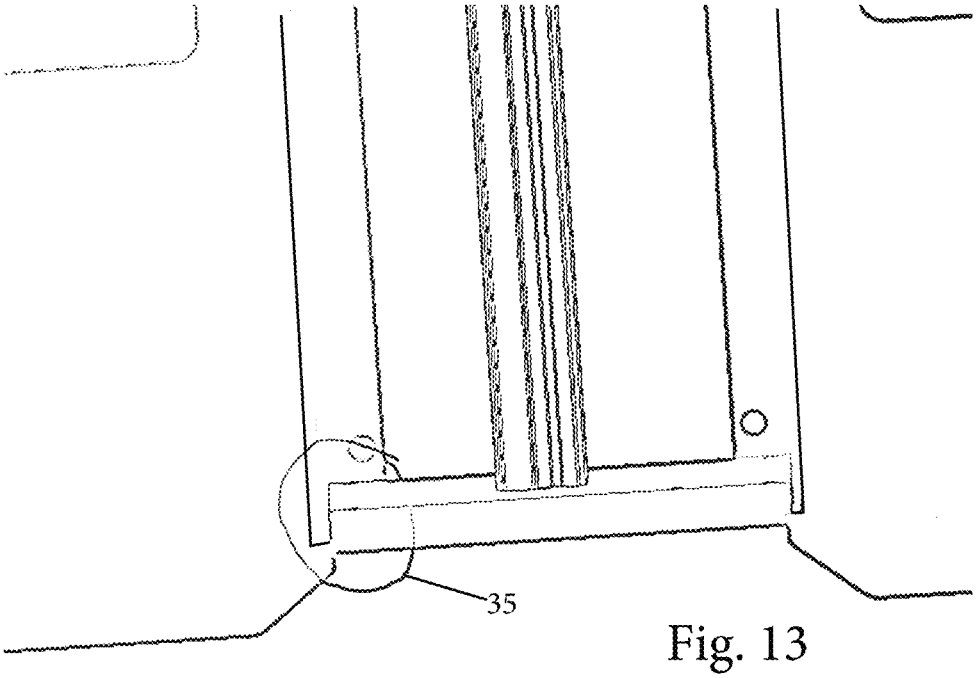
Figure 14:
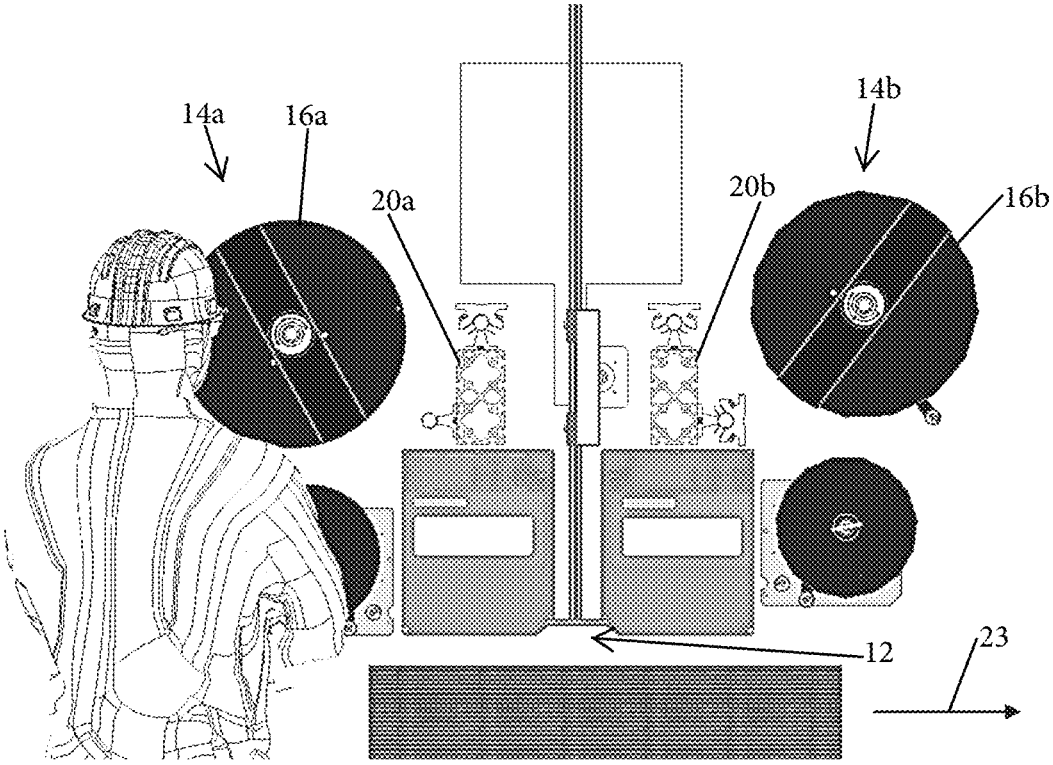
Figure 15:
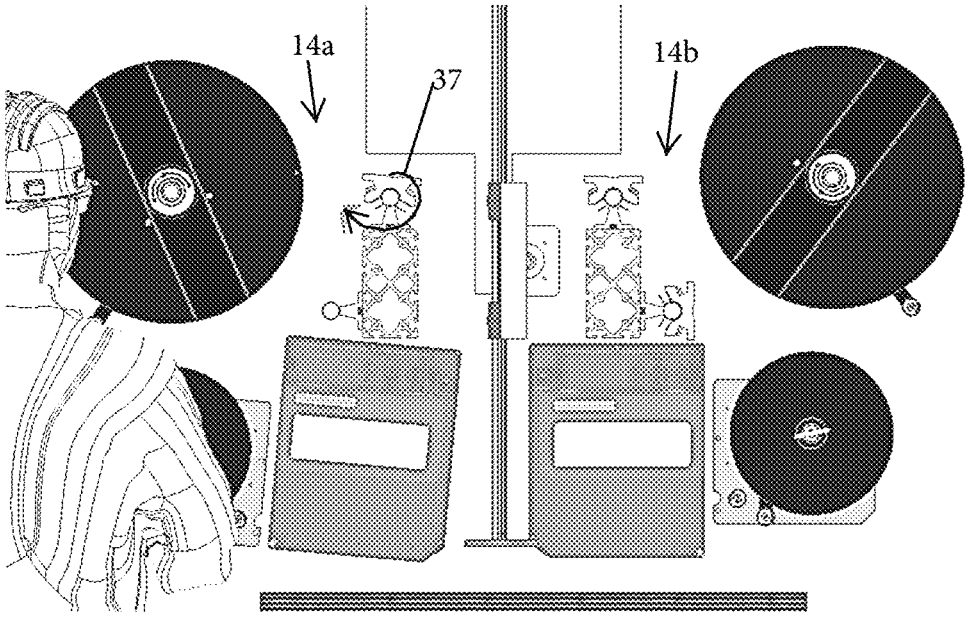
Figure 16:
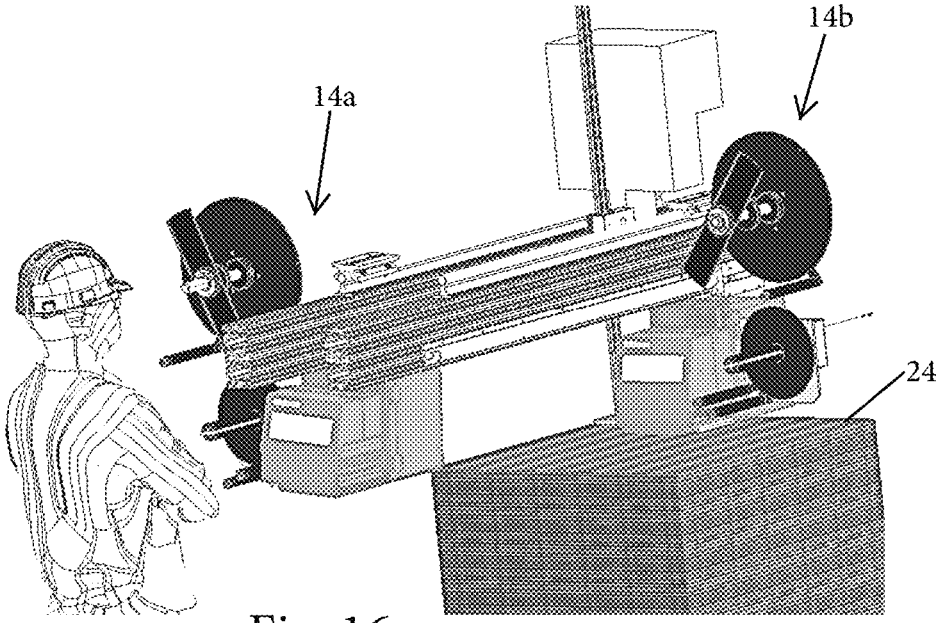
Figure 17:
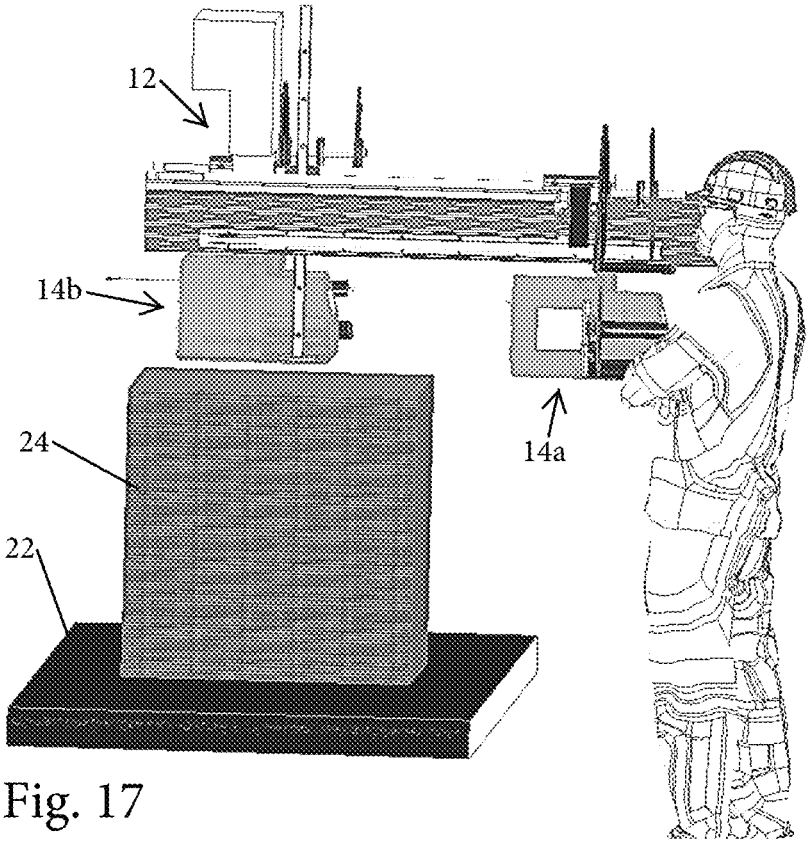

In certain embodiments, the label print and dispense units 14*a*, 14*b* are at their respective use positions (shown in FIGS. 12 and 13), there may be some overlap between the structure of the units 14*a*, 14*b* and the structure of the label applier 12, as suggested by area 35 in FIG. 13. This overlap may act to inhibit movement of the units 14*a*, 14*b* to the non-use positions. In order to overcome this issue, in one embodiment, the units 14*a*, 14*b* may be mounted to the respective rail segments 20*a*, 20*b* in a manner that permits some pivot or rotation of the unit, as shown by arrow 37 for unit 14*a* and FIG. 15. In one embodiment, each label print and dispense unit 14*a*, 14*b* may rotate relative to its respective rail segment. In another embodiment, each rail segment may itself be rotatable, so that the unit rotates with the rail segment. In either case, the pivot or rotation then removes or eliminates the overlap between the structure of the unit 14*a* and the structure of the label applier, allowing the unit 14*a* to move to its access position (shown in FIGS. 16 and 17). This pivot or rotation also reduces the potential for a jam if a label was only partially fed out of the unit, causing a printer error, requiring movement of the unit to the access position. The label flag (end segment of label protruding from the label print and dispense unit) will likewise pivot or rotate away to prevent interference with the other label print and dispense unit that takes over feeding of labels to the label applier 12. The pivot or rotation movement of each unit 14*a*, 14*b* could be restricted to being enabled only when the respective unit is offline or not in service.

Figure 18:
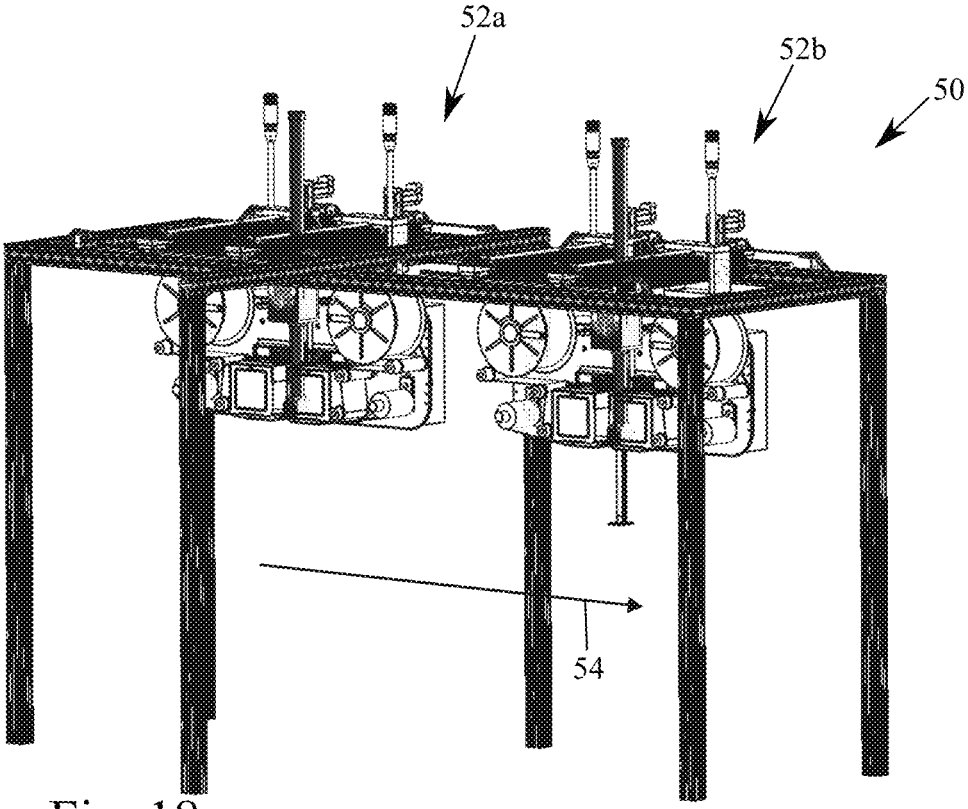
FIGS. 18-20 show another embodiment of an overhead label print and apply system.
Figure 19:
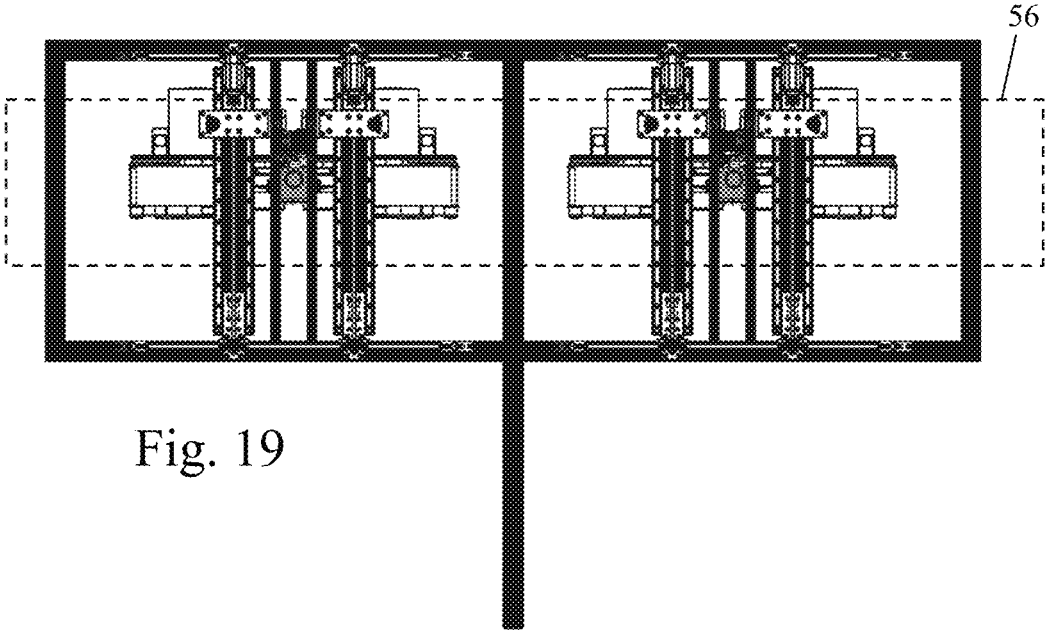
Figure 20:
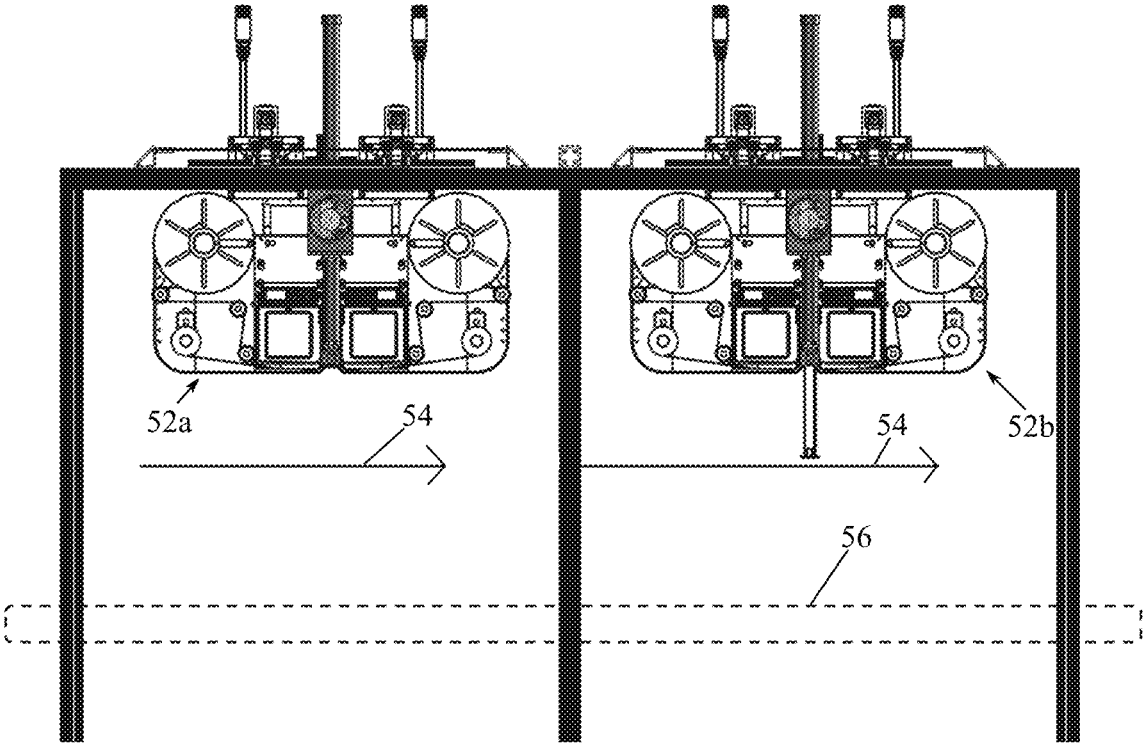

Referring now to FIGS. 18-20, an embodiment of a system 50 including two overhead label print and apply systems 52*a*, 52*b* located back to back along a conveyance direction 54 of a conveyor/conveyance path 56 is shown. Each label print and apply system 52*a*, 52*b* is similar to that of system 10' above, with both label print and dispense units of each system 52*a*, 52*b* being independently movable along a respective rail to the same side of the conveyor 56. Such an arrangement can be used, for example, to increase labeling speed. For example, where each system 52*a*, 52*b* is capable of labeling 40 cases per minute, the combined system can achieve 80 cases per minute, with systems 52*a* and 52*b* applying labels alternatingly to the cases traveling along the conveyor.

The foregoing is provided for purposes of illustrating, explaining, and describing embodiments of labeling apparatus. Modifications and adaptations to these embodiments will be apparent to those skilled in the art and may be made without departing from the scope or spirit of this application. For example, while the above description primarily contemplates the two different print and dispense units carrying the same label type (e.g., size and shape), it is recognized that, in some implementations, the two units could carry different label types, in which case the controller can be configured to select which label print and dispense unit will print and feed a label to the common label applier based upon some predefined condition (e.g., such as size of case being labeled, content of case being labeled or other condition).

What is claimed is:

1. An overhead label print and apply system, comprising:

a conveyance path;

a common label applier located above the conveyance path, wherein the common label applier includes a label applying plate or pad that is movable from a label receiving position toward the conveyance path for applying labels;

a first label print and dispense unit;

a second label print and dispense unit;

wherein the first label print and dispense unit is positionable in a use position to feed printed labels to the label applying plate or pad in the label receiving position and is movable out of the use position and away from the common label applier;

wherein the second label print and dispense unit is positionable in a use position to feed printed labels to the label applying plate or pad in the label receiving position and is movable out of its use position and away from the common label applier;

wherein the common label applier is configured to move the label applying plate or pad from the label receiving position downward toward the conveyance path to apply labels;

wherein the common label applier is configured such that labels received on the label applying plate or pad from the first label print and dispense unit and labels received on the label applying plate or pad from the second label print and dispense unit follow a same direction and path of movement toward the conveyance path;

wherein the first label print and dispense unit, when in its use position, is located at a first side of the common label applier and laterally within a footprint of the conveyance path;

wherein the second label print and dispense unit, when in its use position, is located at a second side of the common label applier and laterally within the footprint of the conveyance path, wherein the second side is opposite the first side;

wherein the first label print and dispense unit, when in its use position, is configured to feed labels to the label applying plate or pad in a first direction that runs from the first side toward the second side such that labels are first fed from the label dispense unit laterally in the first direction before being moved downward by the label applying plate or pad;

wherein the second label print and dispense unit, when in its use position, is configured to feed labels to the label applying plate or pad in a second direction that runs from the second side toward the first side such that labels are first fed from the label dispense unit laterally in the second direction before being moved downward by the label applying plate or pad;

wherein each of the common label applier, the first label print and dispense unit and the second label print and dispense unit is mounted on an overhead rail system that extends transverse to a travel direction of the conveyance path;

wherein the first label print and dispense unit is movable, independently of the second label print and dispense unit, along the overhead rail system between its use position, proximate to the common label applier, and an access position spaced away from the common label applier;

wherein the second label print and dispense unit is movable, independently of the first label print and dispense unit, along the overhead rail system between its use position, proximate to the common label applier, and an access position spaced away from the common label applier, wherein the access position of the first label print and dispense unit is positioned laterally outside the footprint of the conveyance path;

wherein the access position of the second label print and dispense unit is positioned laterally outside the footprint of the conveyance path.

2. The system of claim 1, wherein the first direction runs substantially upstream to downstream along the conveyance path:

wherein the second direction runs substantially downstream to upstream along the conveyance path.

3. The system of claim 1, wherein the first direction runs substantially perpendicular to a conveyance direction of the conveyance path:

wherein the second direction runs substantially opposite the first direction.

4. The system of claim 1, wherein the access position of the first label print and dispense unit and the access position of the second label print and dispense unit are both located on the same side of the conveyance path.

5. The system of claim 1, wherein the access position of the first label print and dispense unit is located on one side of the conveyance path, and the access position of the second label print and dispense unit is located on an opposite side of the conveyance path.

6. The system of claim 1, wherein the first label print and dispense unit is movable manually along the rail system between its use position and its access position, and the second label print and dispense unit is movable manually along the rail system between its use position and its access position.

7. The system of claim 1, wherein the first label print and dispense unit is movable by a first drive along the rail system between its use position and its access position, and the second label print and dispense unit is movable by a second drive along the rail system between its use position and its access position.

8. The system of claim 7, wherein the first drive is operable via a first switch and/or automatically by a controller based upon a first monitored condition, and the second drive is operable via a second switch and/or automatically by a controller based upon a second monitored condition.

9. The system of claim 1, further comprising:

a controller associated with the label applier, the first label print and dispense unit and the second label print and dispense unit;

wherein the controller is configured such that only one of the first label print and dispense unit or the second label print and dispense unit is active at any time.

10. The system of claim 1, wherein the first label print and dispense unit includes a supply of labels of a specified type, and the second label print and dispense unit includes a supply of labels of the specified type.

11. The system of claim 1, wherein the first label print and dispense unit includes a supply of labels of a first specified type, and the second label print and dispense unit includes a supply of labels of a second specified type that is different than the first specified type.

12. A method of labeling items moving along a conveyance path, comprising:

(a) using an overhead label print and apply system that includes a common label applier, a first label print and dispense unit and a second label print and dispense unit, wherein the common label applier includes a label applying plate or pad that is movable from a label receiving position toward the conveyance path for applying labels;

(b) the common label applier applying a first label to a first item moving along the conveyance path, wherein the first label is fed, by the first label print and dispense unit, to the label applying plate or pad while the label applying plate or pad is in the label receiving position; and (c) after step (b), the common label applier applying a second label to a second item moving along the conveyance path, wherein the second label is fed, by the second label print and dispense unit, to the label applying plate or pad while the label applying plate or pad is in the label receiving position;

wherein the common label applier is configured and positioned such that (i) the label applying plate or pad, while in the label receiving position, receives the first label from the first label print and dispense unit and then moves the first label downward toward the conveyance path and onto the first item and (ii) the label applying plate or pad, while in the label receiving position, receives the second label from the second label print and dispense unit and then moves the second label downward toward the conveyance path and onto the second item.

13. The method of claim 12, wherein step (c) occurs only after the first label print and dispense unit runs out of labels or otherwise faults.

14. The method of claim 12, wherein step (c) occurs based upon detection of a predefined condition.

15. The method of claim 12, wherein step (b) and (c) occur alternatingly, for every other item being labeled.

16. An overhead label application system, comprising:

a conveyance path;

a common label applier located above the conveyance path, wherein the common label applier includes a label applying plate or pad that is movable from a label receiving position toward the conveyance path for applying labels, wherein the label applying plate or pad is within a footprint of the conveyance path when in the label receiving position;

a first label dispense unit;

a second label dispense unit;

wherein the first label dispense unit is positioned in a first use position adjacent the common label applier to feed labels to the label applying plate or pad in the label receiving position;

wherein the second label dispense unit is positioned in a second use position adjacent the common label applier to feed labels to the label applying plate or pad in the label receiving position;

wherein the common label applier is configured such that labels received from the first label dispense unit and labels received from the second label dispense unit follow a same direction and path of movement toward the conveyance path.

17. The system of claim 16, wherein the common label applier is configured to move labels downward toward the conveyance path.

18. The system of claim 16, wherein:

the first label dispense unit is mounted on a rail system for movement, independently of the second label dispense unit, between the first use position and a first access position in which the first label dispense unit is spaced away from the common label applier;

the second label dispense unit is mounted on the rail system for movement, independently of the first label dispense unit, between the second use position and a second access position in which the second label dispense unit is spaced away from the common label applier.

19. The system of claim 18, wherein:

wherein the first use position is located laterally within the footprint of the conveyance path and the first access position is located laterally outside the footprint of the conveyance path;

wherein the second use position is located laterally within the footprint of the conveyance path and the second access position is located laterally outside the footprint of the conveyance path.

* * * * *